US008112923B2

(12) United States Patent
Conant

(10) Patent No.: US 8,112,923 B2
(45) Date of Patent: Feb. 14, 2012

(54) METHOD OF AND SYSTEM FOR TWO-WAY SEE-THROUGH BANNER AND WINDOW IMAGING

(75) Inventor: George Conant, Dallas, TX (US)

(73) Assignee: Meisel Photographic Corporation, Carrollton, TX (US)

( * ) Notice: Subject to any disclaimer, the term of this patent is extended or adjusted under 35 U.S.C. 154(b) by 302 days.

(21) Appl. No.: 12/188,393

(22) Filed: Aug. 8, 2008

(65) Prior Publication Data

US 2009/0249666 A1 Oct. 8, 2009

Related U.S. Application Data

(60) Provisional application No. 61/045,719, filed on Apr. 17, 2008, provisional application No. 61/042,149, filed on Apr. 3, 2008.

(51) Int. Cl.
*G09F 7/12* (2006.01)

(52) U.S. Cl. ..... 40/594; 428/137; 428/138; 156/253

(58) Field of Classification Search ..... 40/594, 40/593; 428/40.1, 41.6–41.8, 42.1, 43, 131, 428/132, 134–140, 343; 296/97.3
See application file for complete search history.

(56) References Cited

U.S. PATENT DOCUMENTS 2,880,541 A * 4/1959 Kahn ..... 428/203
4,673,609 A 6/1987 Hill
4,883,556 A 11/1989 Leavitt, Sr. et al.
4,940,622 A 7/1990 Leavitt, Sr. et al.
4,955,709 A 9/1990 Smith
5,525,177 A 6/1996 Ross
5,609,938 A * 3/1997 Shields ..... 428/138
5,679,435 A * 10/1997 Andriash ..... 428/137
5,773,110 A * 6/1998 Shields ..... 428/40.1
5,810,494 A 9/1998 Menard et al.
5,830,529 A * 11/1998 Ross ..... 427/152
5,858,155 A 1/1999 Hill et al.
5,925,437 A 7/1999 Nelson
5,939,168 A 8/1999 Andriash
6,030,687 A 2/2000 Andriash
6,155,689 A 12/2000 Smith
(Continued)

FOREIGN PATENT DOCUMENTS

AT E-215455 4/2002
(Continued)

OTHER PUBLICATIONS

Korean Intellectual Property Office, "International Search Report for PCT/US2009/035516" as mailed Oct. 13, 2009. (3 pages).

*Primary Examiner* — Joanne Silbermann
*Assistant Examiner* — Shin Kim
(74) *Attorney, Agent, or Firm* — Winstead PC

(57) ABSTRACT

A two-way see-through banner. The two-way see-through banner includes a first side having a first image printed thereupon, a second side having a second image printed thereupon, and a plurality of perforating holes through the banner. The perforating holes are created only after the first image and the second image have been printed on the first and second sides of the banner.

21 Claims, 5 Drawing Sheets

U.S. PATENT DOCUMENTS

| | | | | |
|---|---|---|---|---|
| 6,176,958 | B1 | 1/2001 | Shea | |
| 6,258,429 | B1 * | 7/2001 | Nelson | 428/42.1 |
| 6,477,352 | B2 | 11/2002 | Takahashi et al. | |
| 6,481,857 | B2 | 11/2002 | Smith | |
| 6,736,519 | B2 | 5/2004 | Smith | |
| 6,872,435 | B2 * | 3/2005 | Bull et al. | 428/40.1 |
| 7,018,501 | B1 * | 3/2006 | Nelson | 156/253 |
| 7,095,527 | B2 | 8/2006 | Ahrens | |
| 7,198,372 | B2 | 4/2007 | Aeling et al. | |
| 2007/0097441 | A1 | 5/2007 | Wang | |
| 2008/0052973 | A1 | 3/2008 | Mullins | |

FOREIGN PATENT DOCUMENTS

| | | | |
|---|---|---|---|
| BE | 0778802 | | 4/2002 |
| CA | 2197092 | | 3/1996 |
| DE | 69526231 | | 10/2002 |
| DK | 778802 | | 7/2002 |
| EP | 1015135 | | 6/2005 |
| JP | 8221023 | A | 8/1996 |
| JP | 9062189 | A | 3/1997 |
| JP | 1997062189 | A | 3/1997 |
| JP | 2005018050 | A | 1/2005 |

* cited by examiner

METHOD OF AND SYSTEM FOR TWO-WAY SEE-THROUGH BANNER AND WINDOW IMAGING

CROSS REFERENCE TO RELATED APPLICATIONS

This patent application claims priority from, and incorporates by reference for any purpose, the entire disclosures of U.S. Provisional Patent Application No. 61/045,719, filed Apr. 17, 2008, and U.S. Provisional Patent Application No. 61/042,149, filed Apr. 3, 2008.

BACKGROUND

1. Field of Invention

The invention relates generally to visual media and methods of manufacture thereof, having an image on each of two sides and through which a user can see without seeing an image on the other side of the visual media. More particularly, but not by way of limitation, the invention relates to a visual media produced by creating holes in the visual media after an image has been placed on each side of the visual media.

2. History of the Related Art

Point-of-purchase graphics used, for example, by retailers are often large (e.g., 40"×80") but can also be small (e.g., 8"×10"). They can, for example, adhere to windows in places such as malls or free-standing stores, hang in stores or other businesses, be attached to fixtures, or hang in windows.

The retail graphics industry has three distinct segments—design, manufacturing, and distribution. In a typical process, a printer receives an image design in a digital format. The printer then takes the design in digital format and prints images of the design onto a piece made of one or more of a variety of materials, such as fabric, paper, boards, plastics, or vinyls. Once the piece has been printed on, it is usually distributed to a customer's store or to a distribution center.

Manufacturing of retail graphics is generally segmented into two technology types—screen printing and digital printing. Screen printing is an older technique that is very labor-intensive. In contrast, digital printing is a newer technology that is rapidly taking over the screen-printing segment.

Graphic advertising may be placed, for example, on the side of bus or taxi windows so that an advertising message can be seen from the outside and, at the same time, an occupant of the taxi or bus can see out. In a typical case, such as an application on buses or taxis, a graphic is present on one side and a black film is present on the other side.

SUMMARY OF THE INVENTION

A method of manufacturing a two-way see-through banner includes printing a first image onto a first side of a material, printing a second image onto a second side of the material, and perforating the material with a plurality of holes after the first image and the second image have been printed.

A method of manufacturing a two-way see-through banner includes printing a first image onto a first side of a material, printing a second image onto a second side of the material, applying an adhesive to either the first side or the second side of the material, and perforating the material after the first image and the second image have been printed. The adhesive may be applied before or after the material has been perforated.

A two-way see-through banner includes a first side having a first image printed thereupon, a second side having a second image printed thereupon, and a plurality of perforating holes through the banner. The perforating holes are created only after the first image and the second image are printed on the first and second sides of the banner.

A method of using a two-way see-through banner includes displaying the two-way see-through banner by either hanging the banner from a fixture or applying the banner to a window with an adhesive. In the case of applying the banner to a window, the window may be, for example, either a store window or a vehicle window.

DETAILED DESCRIPTION OF ILLUSTRATIVE EMBODIMENTS OF THE INVENTION

Figure 1:
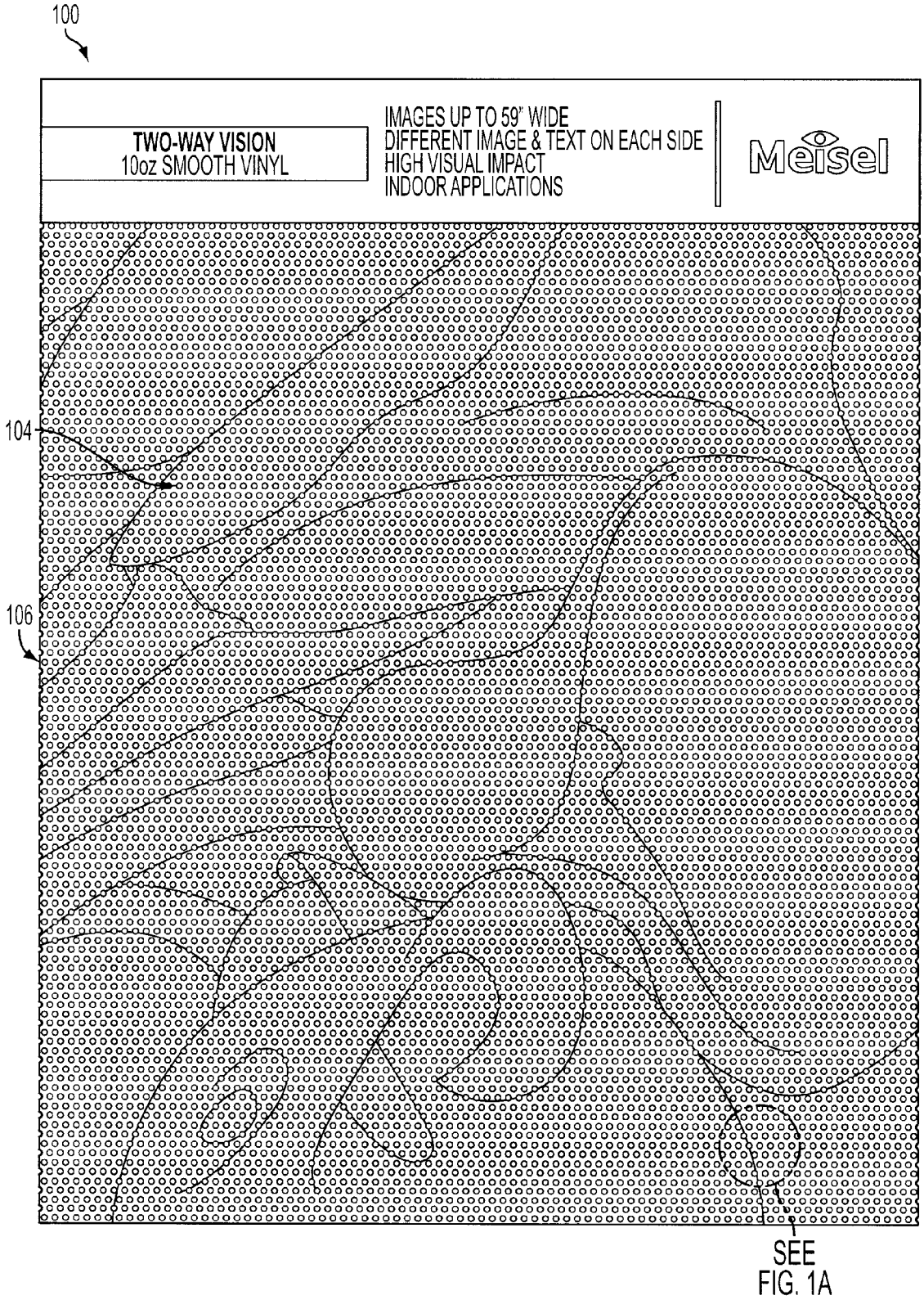
FIG. 1 illustrates a first side of an exemplary two-way see-through banner.

Reference is now made, in detail, to illustrative embodiments of the invention as shown in the accompanying Drawings. The invention may, however, be embodied in many different forms, and should not be construed as being limited to the embodiments set forth herein. The invention should only be considered limited by the claims and the equivalents thereof. Wherever possible, the same reference numerals are used throughout the drawings to refer to the same or similar parts.

Figure 2:
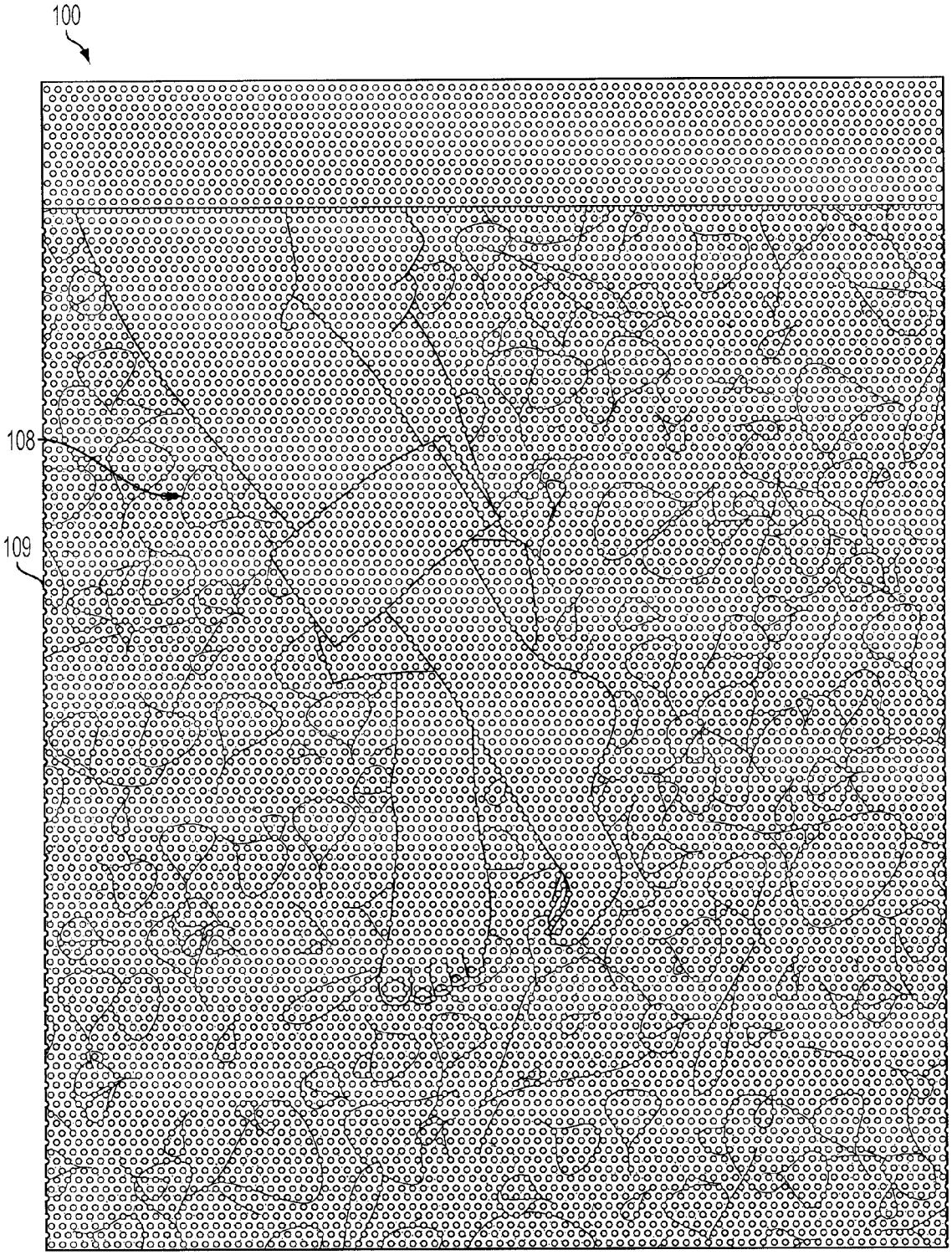
FIG. 2 illustrates a second side of the two-way see-through banner of FIG. 1.

Referring first to FIGS. 1 and 2 together, there is shown a banner 100. The banner 100 includes an image present on both sides of a printed material 102. In a typical case, a user can see a first image 104 on a first side 106 and, at the same time, see through the printed material 102. The user can see a second image 108 on a second side 109 and also see through the printed material 102. In other cases, the same image may be present on both of the sides 106 and 109 of the printed material 102. A plurality of perforating holes 110 in the printed material allow transmission of light through the printed material 102, and facilitate a user seeing through the printed material 102. The plurality of holes 110 may be of any appropriate size or shape and may be arranged in any appropriate pattern.

Figure 1A:
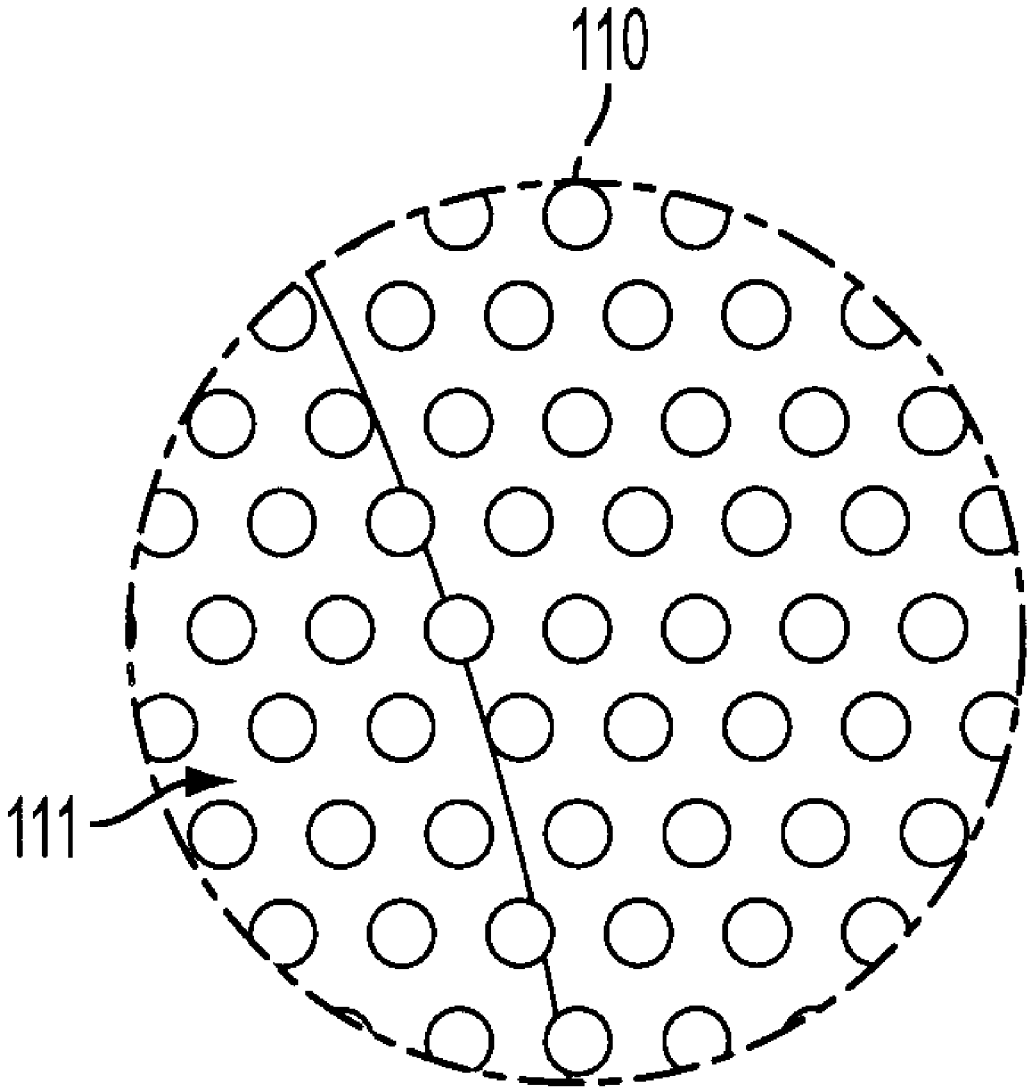
FIG. 1A is an enlarged view of the banner of FIG. 1 showing a plurality of holes arranged in a staggered pattern.

FIG. 1A shows an enlarged view of the first side of the banner 100. The plurality of holes 110 are shown arranged in a staggered hole pattern. The staggered hole pattern offers many advantages, including: an increase in the amount of light transmission and visibility through the banner 100 from about 37% open area to about 50% to 70% open area. The staggered hole pattern also allows a more pleasing psychological impression as compared to grid-like hole patterns because the staggered hole pattern appears to the human eye to be more random and less discernable. Therefore, the through-viewing feature of the banner 100 is enhanced. Third, the staggered hole pattern allows an increase in the thickness of a plurality of web or bar portions 111 disposed between the staggered holes. This increased thickness increases the tensile strength of the banner 100 and improves resistance to shear by eliminating ordered and continuous tear lines. Another advantage of the staggered hole pattern is that the staggered hole pattern enables the banner 100 to conform more readily to curved surfaces of a display medium, such as a vehicle window, without wrinkling.

If a different image is present on each of the first and second sides 106 and 109 of the printed material 102, the retailer then has space for two messages and the ability for a customer or other person to see through the image from either side of the printed material 102. By way of example, the customer might see a "Welcome to our Store" message on one side, a "Thanks for Coming" message on the other and, at the same time, be able to see, from either side, through a medium that does not block out the customer's view or create a wall inside a store that cannot be seen through. By way of example, the banner 100 in FIGS. 1 and 2 is shown as being supported by a fixture. In another option, the banner 100 could be applied to a store window, for example, by way of an adhesive applied to one side of the banner 100. Additionally, the banner 100 could be displayed in a vehicle window such as, for example, a taxi or a passenger bus.

Figure 3:
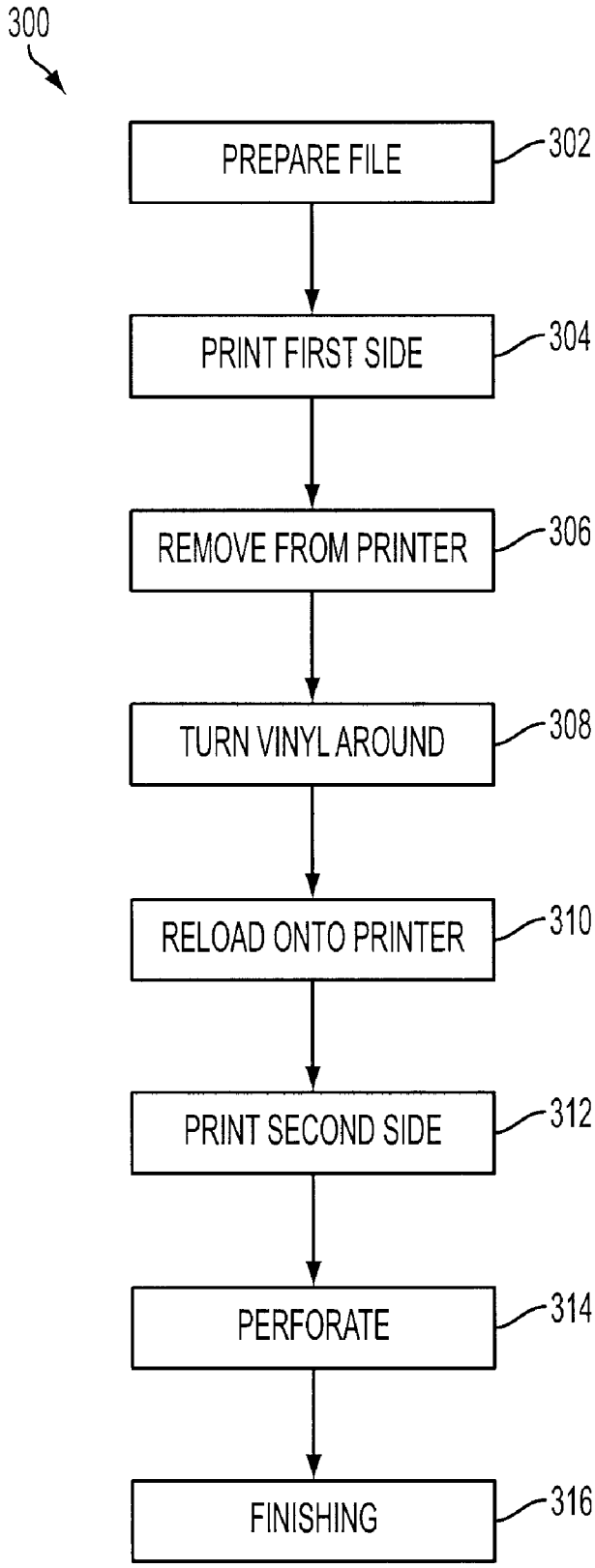
FIG. 3 is a flow diagram of a two-way see-through banner process.

Referring now to FIG. 3, a method of creating a two-way see-through banner is illustrated as a process 300. First, at step 302, at least one digital file is prepared, as is known, and the at least one digital file(s) are sent to a printer to be imaged onto the material 102. If the banner 100 includes a single image to be imaged onto one side, or both sides, of the material 102, then one digital file will be prepared. However, if the banner 100 includes two images, one to be imaged onto the first side 106 of the material 102, and the other to be imaged onto the second side 109 of the material 102, two digital files will be prepared. At step 304, the printer jets ink directly onto the first side 106 of, for example, an ultra-smooth vinyl of about 10 to about 15 oz. per square yard, and typically 13 oz. per square yard. At step 306, the material 102 is removed from the printer. At step 308, the material 102 is turned over to expose the second side 109 for printing. The material 102 is, again, loaded into the printer at step 310. At step 312, an image is printed onto the second side 109 of the material 102. As noted above, this image may be the same image printed in step 304 or could be an entirely different image.

In step 314, a machine is used to perforate the material. The perforation step 314 may be performed using a perforation machine such as those sold by WISTA of Germany and used, for example, for perforating stamps or automotive upholstery. The perforation machine causes the holes 110 to be: (1) properly sized to perforate 10-90%, and typically 10-50% (e.g., 30%) of the material area; (2) uniformly distributed on the material; and (3) completely punched through so that no hanging chads exist. In a typical embodiment, the holes 110 are round and are sized so that there are about 5-30 (e.g., 13) holes per linear inch; however, other shapes and sizes may be used. Shapes that can be used include stars, ovals, squares, diamonds, etc. If the holes 110 are round, they may be about 0.3 mm to about 5 mm (e.g., about 1 mm) in diameter and may be spaced apart from one another a distance that is the same order of magnitude as their diameter. Finally, in step 316, the banner 100 is finished.

In the process 300, in order to achieve better results, the images on the first and second side 106 and 109 of the material 102 should be precisely registered so that, when the banner 100 is trimmed, the images on the first and second side 106 and 109 of the material 102 line up correctly. Moreover, multiple images could be printed on a single roll of material 102 so that the perforation step 314 can be performed in roll-feed form. Step 316 typically includes the addition of any pockets, grommets, or hems that may be required by a particular customer.

Figure 4:
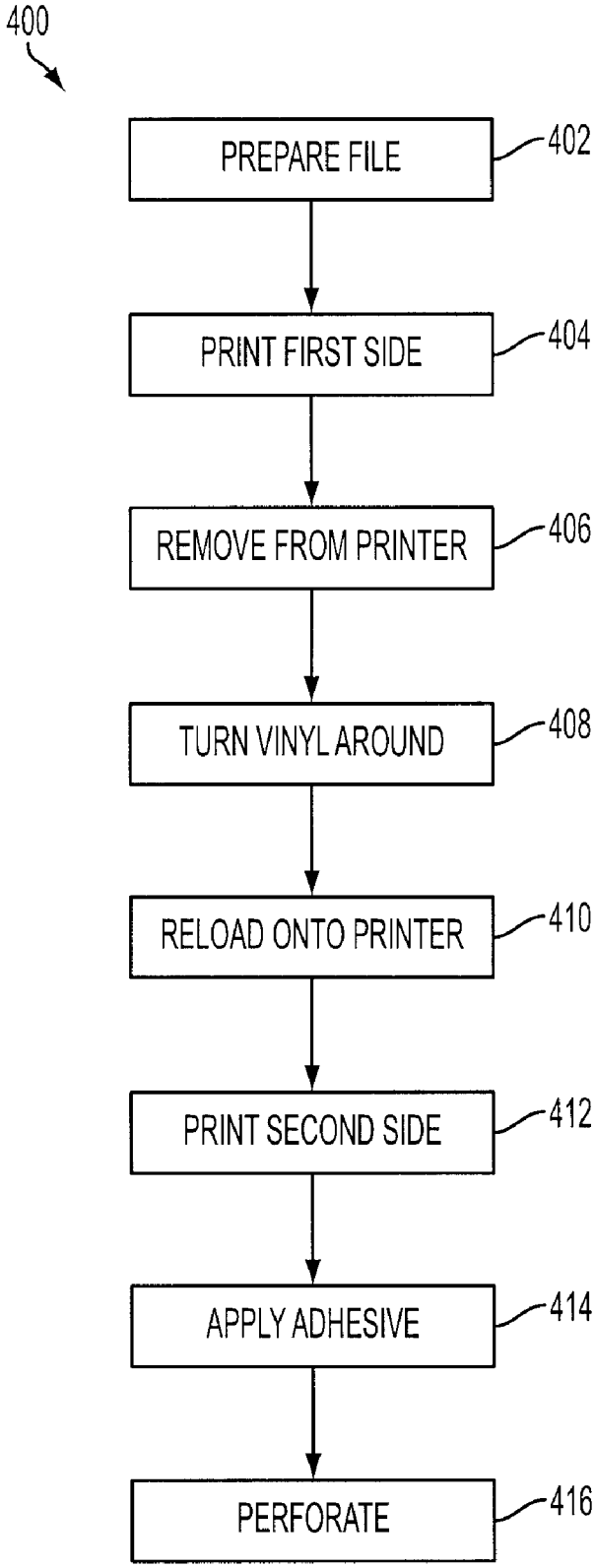
FIG. 4 is a flow diagram of a two-way see-through window image process.

Referring next to FIG. 4, a method of creating a two-way see-through window image is illustrated as a process 400. Perforating a two-way see-through window image is sometimes more complicated than perforating a banner as described above, in some cases, because of the added challenge of having to perforate through a gummy adhesive layer. First, at step 402, at least one digital file is prepared, as is known, and the at least one digital file(s) are sent to a printer to be imaged onto the material 102. If the banner 100 includes a single image to be imaged onto one side, or both sides, of the material, then one digital file will be prepared. However, if the banner 100 includes two images, one to be imaged onto the first side 106 of the material 102, and the other to be imaged onto the second side 109 of the material 102, two digital files will be prepared. At step 404, the printer jets ink directly onto the first side 106 of, for example, an ultra-smooth vinyl of about 10 to about 15 oz. per square yard, and typically 13 oz. per square yard. At step 406, the material 102 is removed from the printer. At step 408, the material 102 is turned over to expose the second side 109 for printing. The material 102 is again loaded into the printer at step 410. At step 412, an image is printed onto the second side 109 of the material. As noted above, this image may be the same image printed in step 404 or could be an entirely different image. In step 414, an optically clear, very thin layer of low-tack adhesive is applied to either the first or second side 106 or 109 of the material 102. The low-tack adhesive may include a special liner to protect the adhesive before its intended use.

In step 416, a machine is used to perforate the material. The perforation step 416 may be done using a perforation machine such as those sold by WISTA of Germany and used for perforating stamps or automotive upholstery. The perforation machine causes the holes 110 to be: (1) properly sized to perforate 10-90%, and typically 10-50% (e.g., 50%) of the material 102 area; (2) uniformly distributed on the material 102; and (3) completely punched through so that no hanging chads exist. In an embodiment, the holes 110 are round and are sized so that there are about 5-30 (e.g., 13) holes per linear inch; however, other shapes and sizes may be used. Shapes that can be used include stars, ovals, squares, diamonds, etc. If the holes 110 are round, they may be about 0.3 mm to about 5 mm (e.g., about 1 mm) in diameter and may be spaced apart from one another a distance that is the same order of magnitude as their diameter.

In the process 400, step 414 of applying adhesive is illustrated as being performed before the perforation performed in step 416. As noted above, when application of adhesive is performed before perforation, additional challenges may be introduced due to the need to perforate through the gummy adhesive layer. However, those having skill in the art will appreciate that, in some embodiments, step 416 may be performed prior to step 414. In other words, perforation of the banner may be performed prior to application of adhesive, particularly when an opaque or transparent adhesive material is applied to the banner following perforation so that the adhesive layer does not unduly block light from passing through the perforations made in the banner.

In the process 400, in order to achieve optimal results, the images on the first and second sides 106 and 109 of the material 102 should be precisely registered so that, when the visual media 100 is trimmed, the images on either side of the material 102 line up correctly. Moreover, multiple images could be printed on one roll so that the perforation step can be performed in roll-feed form.

Although the perforation steps 314 and 416 are described above as the way in which holes are formed, the holes can be formed in any way that results in holes that have no, or minimal, hanging chads. For example, the holes can be formed by punching, puncturing, cutting, or boring. Furthermore, the printing steps 304, 314, 404, and 412 are described above as utilizing ink printing as the method of applying an image to the material 102. However, one skilled in the art will recognize that any appropriate method of applying an image to the material 102 may be used, including methods in which an image may be applied to both sides of a material at the same time. Ink printing is illustrated herein by way of example only.

The processes 300 and 400 avoid problems typically encountered when holes are formed prior to printing. In such cases, bleedthrough of the ink often occurs, which can cause an image on one side to be at least partially visible on the other side of the material.

The above hole dimensions and spacing are suitable for an image of approximately 1-20 feet in width and 1-20 feet in length that is adapted to be viewed at a typical distance of less than 100 yards. As the size of the image and the typical viewing distance increase, the suitable hole dimensions and spacing are adjusted to ensure correct results.

Although various embodiments of the invention have been described above, it will be understood that the invention is not limited to the embodiments disclosed, but is capable of numerous rearrangements, modifications, and substitutions. For example, although the Detailed Description has described vinyl as being a possible material for use in the inventive methods, principles of the invention can be applied to other materials, such as fabric, paper, boards, or plastics. In addition, the processes described above may be used in screen-printing operations as well as digital-printing operations without departing from principles of the invention. UV inks, solvent inks, or any other suitable inks may be used. Moreover, although banner and window applications have been described, the processes can be used in other applications such as, for example, doors, walls, and various stationary or mobile displays of greatly varying size without departing from spirit and scope of the invention as set forth in the following claims.

What is claimed is:

1. A method of manufacturing an article of visual media, the method comprising:

applying ink directly onto a first side of a material, thereby creating a first image;

applying ink directly onto a second side of the material, thereby creating a second image; and perforating the material after the first image and the second image have been created.

2. The method of claim 1, further comprising, prior to the applying the ink directly onto the first side, sending a first digital image to a printer.

3. The method claim 1, further comprising, prior to the applying the ink directly onto the second side, sending a second digital image to a printer.

4. The method of claim 1, wherein the perforating the material comprises forming holes that perforate approximately 10% to approximately 50% of an area of the material.

5. The method of claim 1, wherein the perforating the material comprises forming holes having a diameter of approximately 0.3 mm to approximately 1 mm.

6. The method of claim 1, wherein the perforating comprises forming holes such that there are approximately 5 to approximately 30 holes per linear inch.

7. The method of claim 1, further comprising applying an adhesive to at least one of the first side or the second side.

8. The method of claim 7, wherein the perforating precedes the applying the adhesive.

9. The method of claim 1, wherein the perforating the material comprises perforating an entire surface area of the material.

10. An article of visual media comprising:

a unitary sheet of material;

a first image on a first side of the unitary sheet, the first image comprising ink in direct contact with the first side, the first image being not viewable from a second side of the unitary sheet;

a second image on the second side, the second image comprising ink in direct contact with the second side, the second image being not viewable from the first side;

wherein the unitary sheet has a plurality of perforating holes formed therein; and wherein the plurality of perforating holes are created only after the first image and the second image are present on the unitary sheet.

11. The article of claim 10, wherein at least one perforating hole of the plurality of perforating holes has a shape comprising at least one of: round, star-shaped, oval-shaped, or diamond-shaped.

12. The article of claim 10, further comprising an adhesive layer applied to at least one of the first side and the second side.

13. The article of claim 12, wherein the adhesive layer is applied after the plurality of perforating holes have been formed.

14. The article of claim 10, wherein the plurality of perforating holes are arranged to perforate approximately 10% to approximately 50% of an area of the unitary sheet.

15. The article of claim 10, wherein each perforating hole of the plurality of perforating holes has a diameter of approximately 0.3 mm to approximately 1 mm.

16. The article of claim 10, wherein the plurality of perforating holes are sized at approximately 5 to approximately 30 holes per linear inch.

17. The article of claim 10, wherein the first image and the second image are identical.

18. The article of claim 10, wherein the article is displayed from a fixture.

19. The article of claim 10, wherein the article is applied to a window with an adhesive.

20. The article of claim 10, wherein the unitary sheet comprises a unitary sheet of flexible material.

21. The article of claim 10, wherein the plurality of perforating holes are formed in an entire surface area of the unitary sheet.

* * * * *